US007901033B2

(12) United States Patent
Nishida

(10) Patent No.: US 7,901,033 B2
(45) Date of Patent: Mar. 8, 2011

(54) CAPPING DEVICE, AND RECOVERY DEVICE HAVING THE SAME

(75) Inventor: Katsunori Nishida, Aichi-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 482 days.

(21) Appl. No.: 12/030,460

(22) Filed: Feb. 13, 2008

(65) Prior Publication Data

US 2008/0192083 A1 Aug. 14, 2008

(30) Foreign Application Priority Data

Feb. 13, 2007 (JP) ..... 2007-031589

(51) Int. Cl.
*B41J 2/165* (2006.01)

(52) U.S. Cl. ..... 347/31; 347/22; 347/29; 347/30

(58) Field of Classification Search ..... 347/29, 347/30, 31

See application file for complete search history.

(56) References Cited

U.S. PATENT DOCUMENTS

| | | | | |
|---|---|---|---|---|
| 5,055,856 | A * | 10/1991 | Tomii et al. | 347/30 |
| 5,835,109 | A | 11/1998 | Uchida | |
| 6,273,546 | B1 * | 8/2001 | Kobayashi et al. | 347/29 |
| 6,481,826 | B1 * | 11/2002 | Hara et al. | 347/29 |
| 6,565,186 | B1 * | 5/2003 | Hattori et al. | 347/24 |
| 7,195,334 | B2 * | 3/2007 | Nakamura | 347/29 |
| 7,255,420 | B2 * | 8/2007 | Usuda | 347/29 |
| 2003/0210295 | A1 * | 11/2003 | Mitsuzawa et al. | 347/23 |
| 2004/0027409 | A1 * | 2/2004 | Miyauchi | 347/30 |
| 2005/0253488 | A1 | 11/2005 | Ito | |
| 2006/0176333 | A1 * | 8/2006 | Momose et al. | 347/30 |

FOREIGN PATENT DOCUMENTS

| | | | |
|---|---|---|---|
| JP | 6328703 | A | 11/1994 |
| JP | 9070979 | A | 3/1997 |
| JP | 2004142422 | A | 5/2004 |
| JP | 2005313428 | A | 11/2005 |
| JP | 2005322850 | A | 11/2005 |

* cited by examiner

*Primary Examiner* — Ryan Lepisto
(74) *Attorney, Agent, or Firm* — Baker Botts L.L.P.

(57) ABSTRACT

A capping device for a fluid ejection device, includes: a cap having a fluid receptacle and a first fluid path; a cap holder supporting the cap and having a second fluid path; and an absorber disposed between and supported by the cap and the cap holder, the absorber having a third fluid path. Negative pressure is applicable to the fluid receptacle at least through the first, second and third fluid paths.

9 Claims, 9 Drawing Sheets

CAPPING DEVICE, AND RECOVERY DEVICE HAVING THE SAME

CROSS REFERENCE TO RELATED APPLICATION

The present disclosure relates to the subject matter contained in Japanese patent application No. 2007-031589 filed on Feb. 13, 2007, which is expressly incorporated herein by reference in its entirety.

TECHNICAL FIELD

The present invention relates to a capping device suitable for maintaining and/or protecting a fluid ejection device. The present invention also relates to a recovery device including the capping device.

BACKGROUND ART

An ink jet head of an ink jet printer, which is an example of a fluid ejection device, ejects ink drops in a dot matrix onto a surface of a recording medium, such as plain paper, from a minute nozzle hole, to form, for example, characters or figures. Since the ink jet head has to eject each ink drop at a high speed and precisely towards a target from the nozzle hole, problems, such as clogging, at the nozzle hole undesirably lowers landing precision of the ink drops varies ink ejection amount, resulting in lowered print quality.

To eliminate such problems, purging is performed to periodically discharge ink from the nozzle hole, to thereby remove foreign matter, such as air bubbles, solidified ink, or viscosity-increased ink, existing in the nozzle hole. When the printer is not used, the nozzle face is covered with a cap to protect the nozzle hole from drying of the ink in the nozzle hole and adherence of dust to the nozzle hole.

In the purging, the nozzle face of the ink jet head, where the nozzle hole is disposed, is covered with a cap, and ink in an ink flow path of the ink jet head and in the nozzle hole is sucked or ejected, to remove any foreign matter in the ink flow path of the ink jet head and in the nozzle hole. In protecting the nozzle hole, the nozzle face, where the nozzle hole is disposed, is covered with the cap to protect the nozzle hole from adherence of, for example, dust; and to prevent drying of the ink by maintaining the humidity in the cap. This way, the ink in the ink nozzle are prevented from being increased in viscosity and being solidified.

To increase the volume of ink sucked from the nozzle hole in the purging, the cap is provided with an absorber that absorbs ink. In general, the absorber is accommodated in the cap supported by a cap holder, and is secured by, for example, a holding member. For example, Japanese Unexamined Patent Application Publication No. 2004-142422 (page 19, FIG. 24) discloses a cap including a cap base, an absorber accommodating portion, a function liquid absorber, an absorber holding member, a sealing member, and a seal securing member. The absorber accommodating portion is formed at the cap base. The function liquid absorber fills the interior of the absorber accommodating portion. The absorber holding member holds the function liquid absorber. The seal securing member secures the sealing member to the cap base.

However, since the cap for the ink jet head is arranged such that a peripheral edge of the absorber holding member is held by the sealing member and that the sealing member is secured to the cap base by the seal securing member, a large number of parts is required and a large number of assembling steps is required. Further, when securing the absorber holding member, thermal caulking or an ultrasonic welding may be required. Therefore, for example, dimensional precision of the securing position of the absorber holding member with respect to the cap base is required, thereby lowering production efficiency and preventing cost reduction.

SUMMARY

The present invention can provide, as one of illustrative, non-limiting embodiment, a capping device for a fluid ejection device, which includes: a cap having a fluid receptacle and a first fluid path; a cap holder supporting the cap and having a second fluid path; and an absorber disposed between and supported by the cap and the cap holder, the absorber having a third fluid path, and in which negative pressure is applicable to the fluid receptacle at least through the first, second and third fluid paths.

Accordingly, as one of advantages, the present invention can provide a capping device requiring a smaller number of component parts. As another one of the advantages, the present invention can increase production efficiency of a capping device. As yet another one of the advantages, the present invention can reduce costs of a capping device.

These and other advantages of the present invention will be discussed in detail with reference to the accompanying drawings.

DESCRIPTION OF THE PREFERRED EMBODIMENT

Illustrative, non-limiting embodiments of the present invention will be described in detail with reference to a capping device for an ink jet head which is one example of a fluid ejection device.

Figure 1:
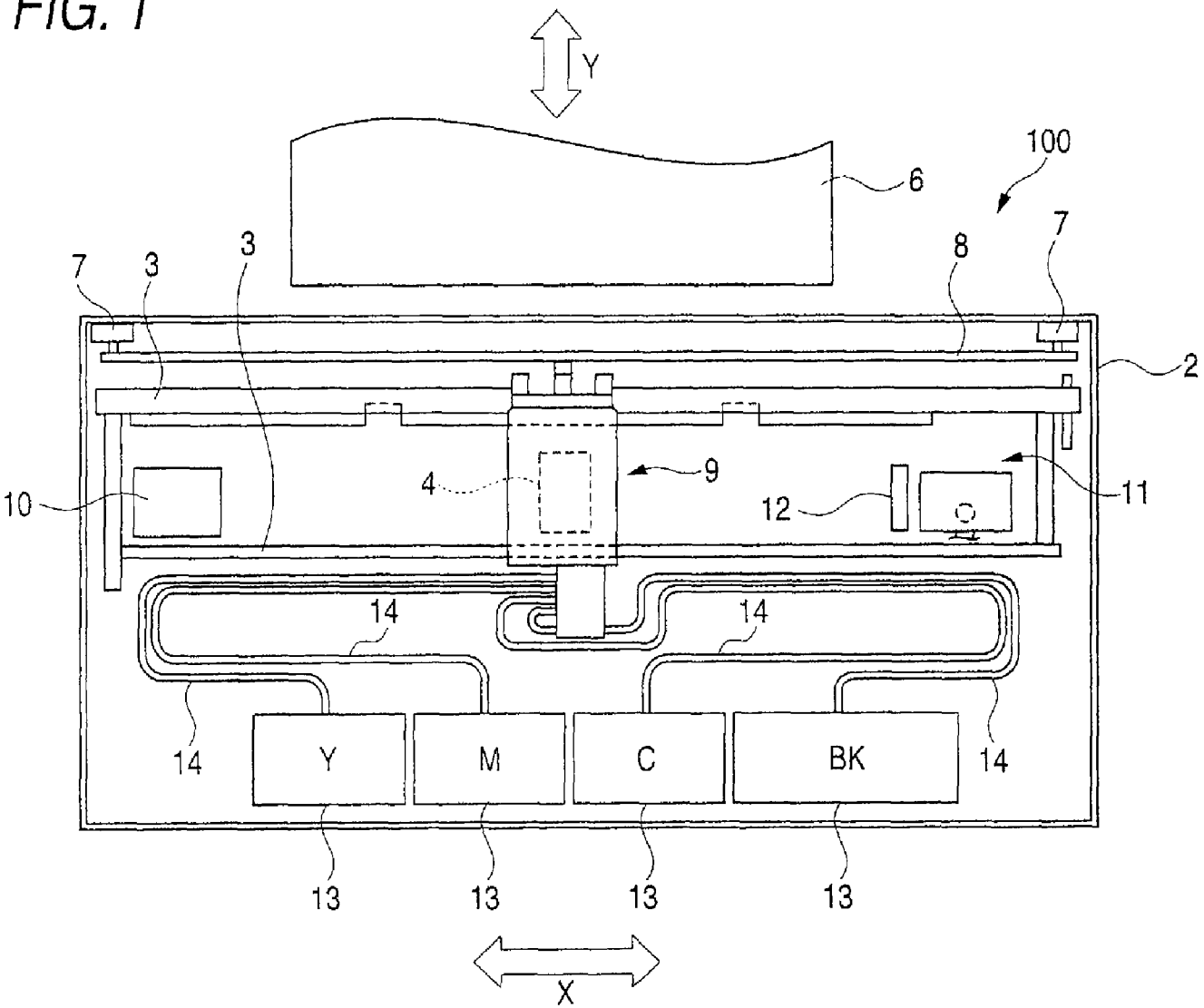
FIG. 1 is a schematic plan view of an internal structure of an ink jet printer including a recovery device including a capping device according to the present invention.

FIG. 1 is a schematic plan view of an internal structure of an ink jet printer 100 including a recovery device 11 including a capping device. The ink jet printer 100 includes guide rods 3 and 3 that are provided between portions of a housing 2, and that support a carriage 9 so that the carriage 9 is slidable in main scanning directions (that is, X directions). An ink jet head 4 is disposed at the carriage 9 so that its nozzle face 4*b*, where a plurality of nozzle holes 4*a* are provided, is exposed to the lower side. A platen (not shown) is disposed below the carriage 9. A sheet-feeding mechanism (not shown) transports a recording medium 6 (such as plain paper) on the platen to sub-scanning directions (that is, Y directions) perpendicular to the main scanning directions, so that the ink jet head 4 ejects ink towards the recording medium 6. The carriage 9 is driven by a timing belt 8 suspended between a pair of pulleys 7. A motor (not shown) rotatable in the forward and reverse direction is connected to one of the pulleys 7. Rotating the pulleys 7 in the forward and reverse direction causes the timing belt 8 to reciprocate, so that the ink jet head 4, mounted to the carriage 9, is scanned in the main scanning directions (that is, the X directions) along the guide rods 3. In the description below, a side to which ink is ejected is defined as the lower side or the downward direction, the opposite side is defined as the upper side or the upward direction, and the scanning directions (that is, the X directions) of the carriage 9 shown in FIG. 1 are defined as the leftward direction and the rightward direction. Ink cartridges 13 are connected to the ink jet head 4 through respective ink supply tubes 14, and store a plurality of inks (such as black (BK) ink, yellow (Y) ink, magenta (M) ink, and cyan (C) ink).

A flashing receiver 10 that receives ink ejected independently of a recording operation from the nozzle holes 4*a* of the ink jet head 4 is disposed below the guide rods 3 and in a non-printing area at one end in the leftward and rightward direction in the housing 2. When the ink jet head 4 is positioned above the flashing receiver 10, ink is periodically or forcibly ejected from the nozzle holes 4*a* to the flashing receiver 10, so that viscosity-increased ink is discharged from the nozzle holes 4*a* to recover from ejection problems, such as clogging of the nozzle holes 4*a*.

The recovery device 11 for a purging operation is disposed in another non-printing area at the other end in the leftward and rightward direction. The recovery device 11 is configured to suck ink intentionally or periodically from the nozzle holes 4*a*. A wiping member 12 that wipes ink adhered to the nozzle face 4*b* after the purging is provided beside the recovery device 11.

Figure 3:
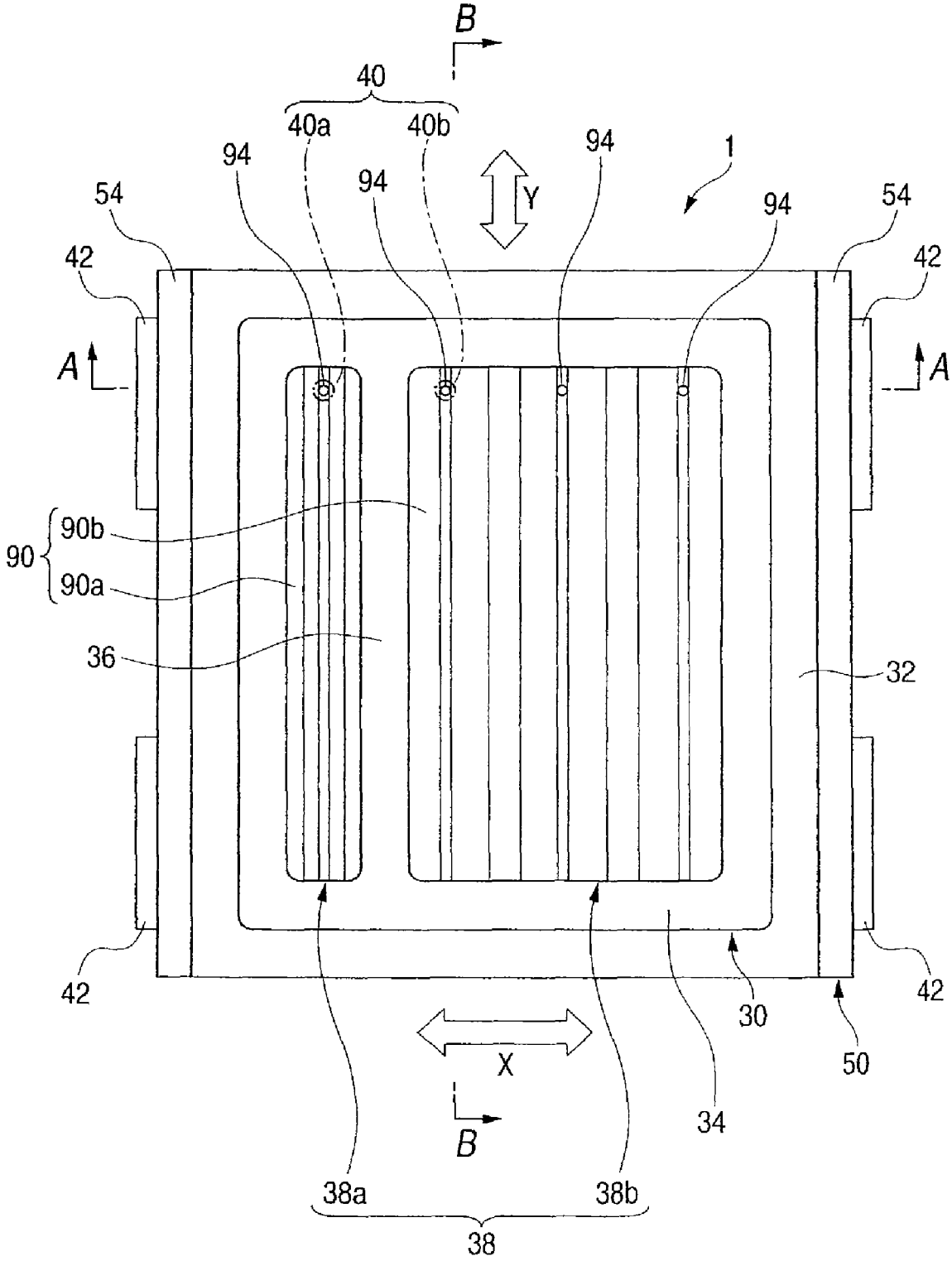
FIG. 3 is a plan view of the capping device according to the present invention.
Figure 4A:
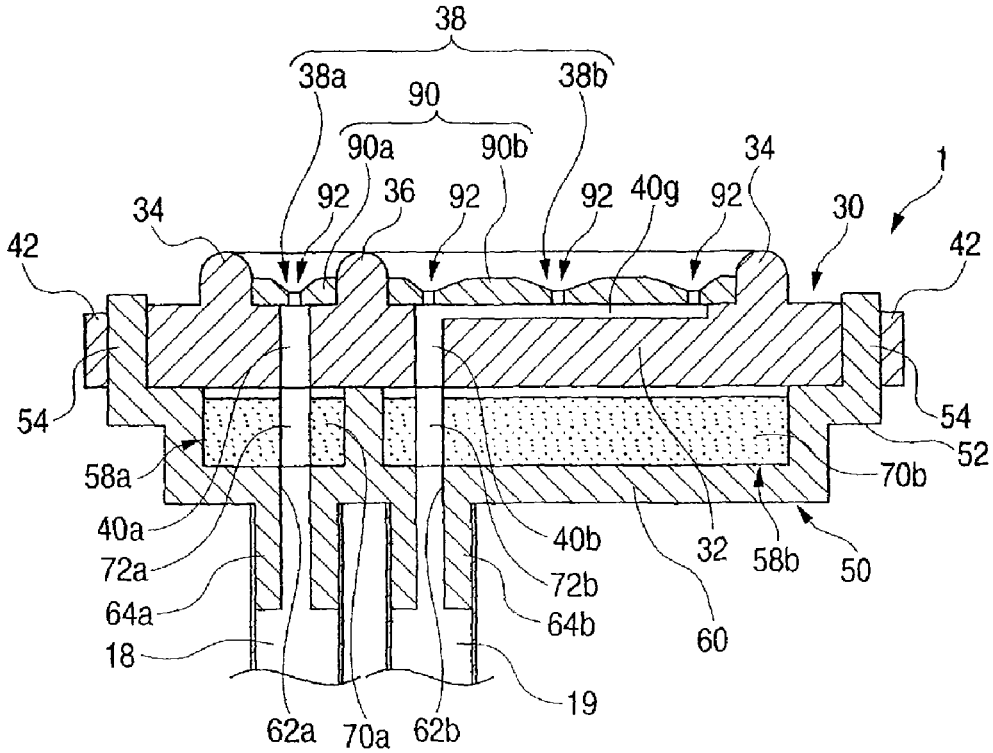
FIG. 4A is an enlarged sectional view taken along arrow A-A in FIG. 3.
Figure 4B:
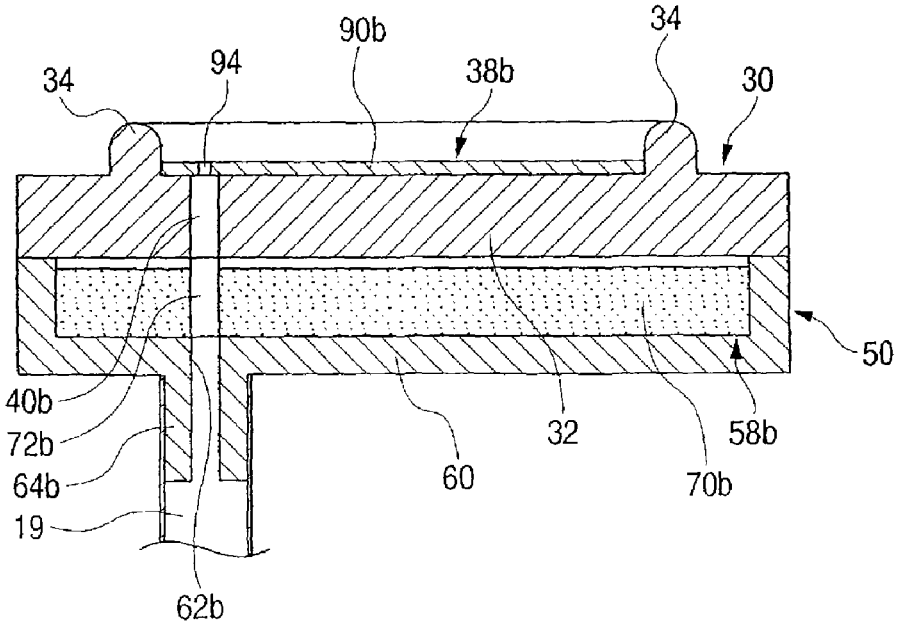
FIG. 4B is an enlarged sectional view taken along arrow B-B in FIG. 3.
Figure 5:
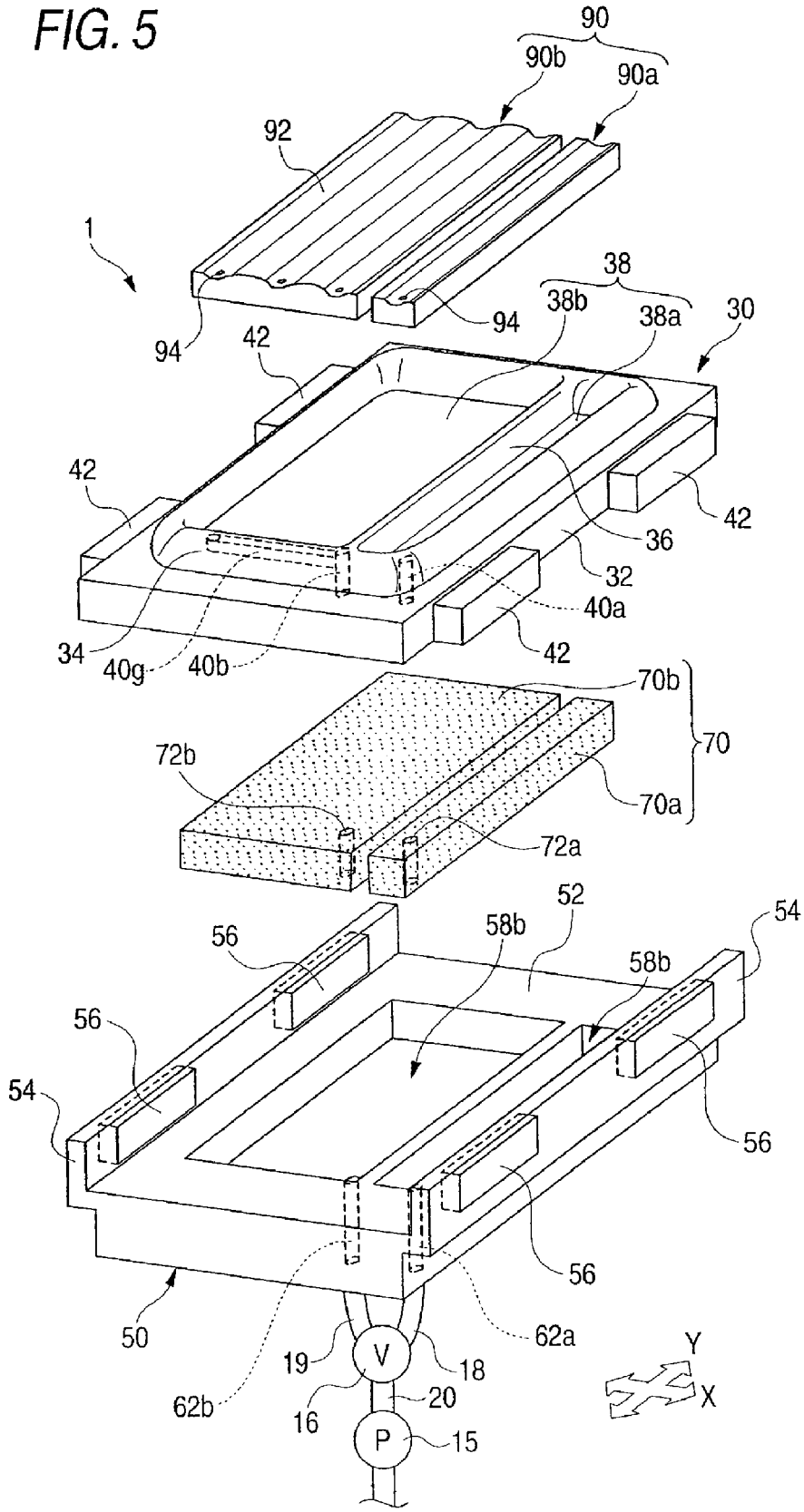
FIG. 5 is an exploded view illustrating the procedure of assembling the capping device.

The recovery device 11 performs a recovery operation as follows. By covering the nozzle face 4*b* of the ink jet head 4 with a capping device 1 (see FIGS. 3 and 4), and operating a suction device 15 (see FIG. 5), the pressure in the capping device 1 becomes negative, to discharge air bubbles and viscosity-increased ink, existing in an ink flow path of the ink jet head 4, from the nozzle holes 4*a*, so that the ejection function of the nozzle holes 4*a* is recovered. In addition, the recovery device 11 can prevent drying of the nozzle holes 4*a* and adherence of dust to the nozzle holes 4*a* and the nozzle face 4*b* by covering and protecting the nozzle face 4*b* with the capping device 1 when recording is not performed.

Figure 2:
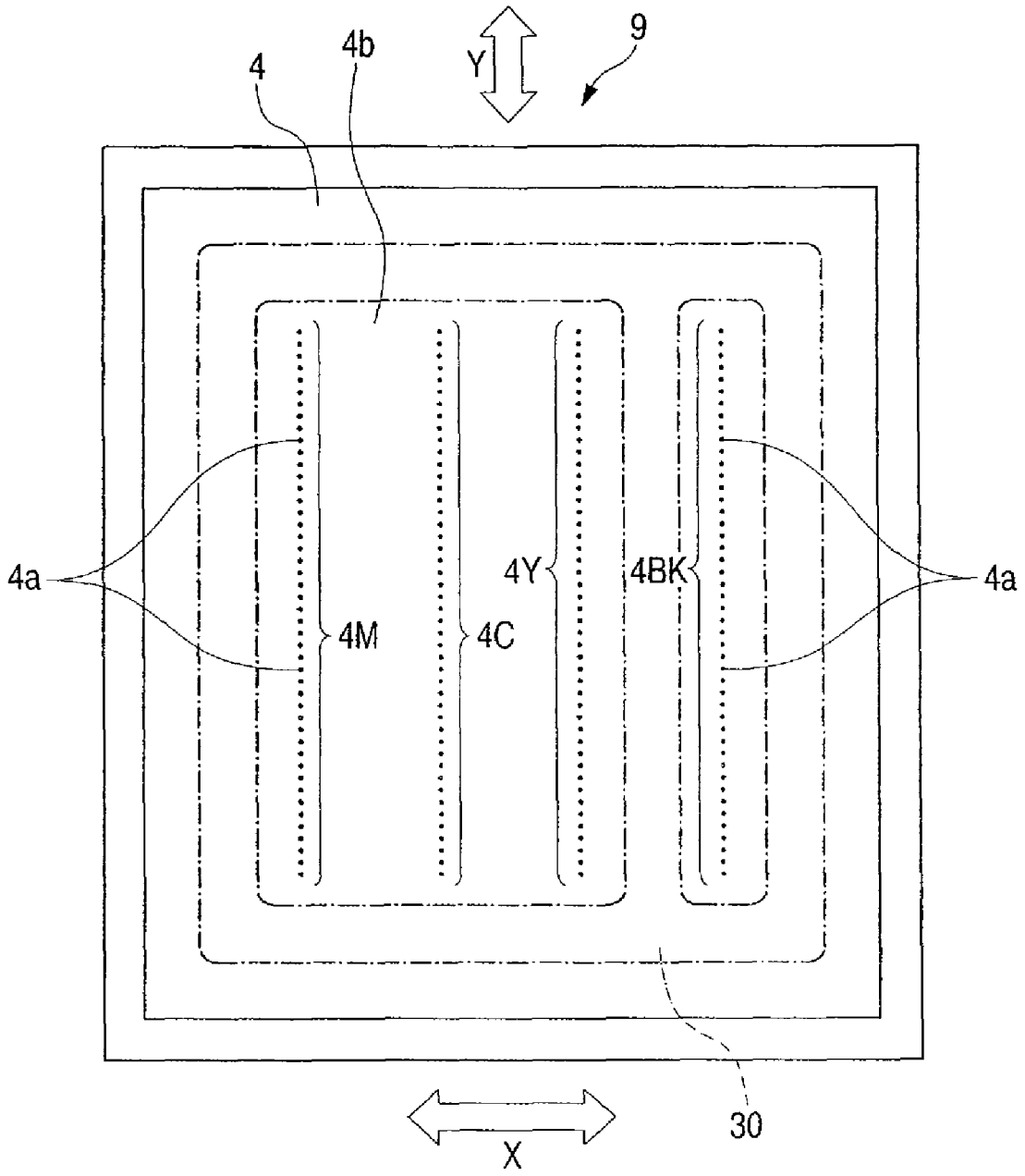
FIG. 2 is an enlarged view of an ink jet head as seen in a direction toward a nozzle face.

As discussed in Japanese Unexamined Patent Application Publication Nos. 2005-322850 and 2005-313428, the ink jet head 4 has a laminated structure having a cavity unit (not shown) and a plate-type piezoelectric actuator (not shown) adhered to the cavity unit. The cavity unit is formed by laminating and adhering a plurality of plates to each other. Ink from the ink cartridges 13 is supplied to the cavity unit. The piezoelectric actuator has a plurality of piezoelectric deformation sections. A flexible wiring member (not shown) to which a driving circuit (not shown) is mounted is disposed on the top surface of the piezoelectric actuator, and is electrically connected to the piezoelectric actuator. The plurality of nozzle holes 4*a* are disposed in the nozzle face 4*b* (which is the lowest surface of the cavity unit) so as to form nozzle arrays in the Y direction according to respective ink colors as shown in FIG. 2. Nozzle arrays 4BK, 4Y, 4C, and 4M are provided in the nozzle face 4*b* so as to be arranged in the X direction (that is, the scanning direction of the carriage 9). A print signal from the driving circuit causes the corresponding piezoelectric deformation section to be selectively deformed, so that ink is ejected from the nozzle hole 4*a* corresponding to the deformed piezoelectric deformation section.

Figure 6A:
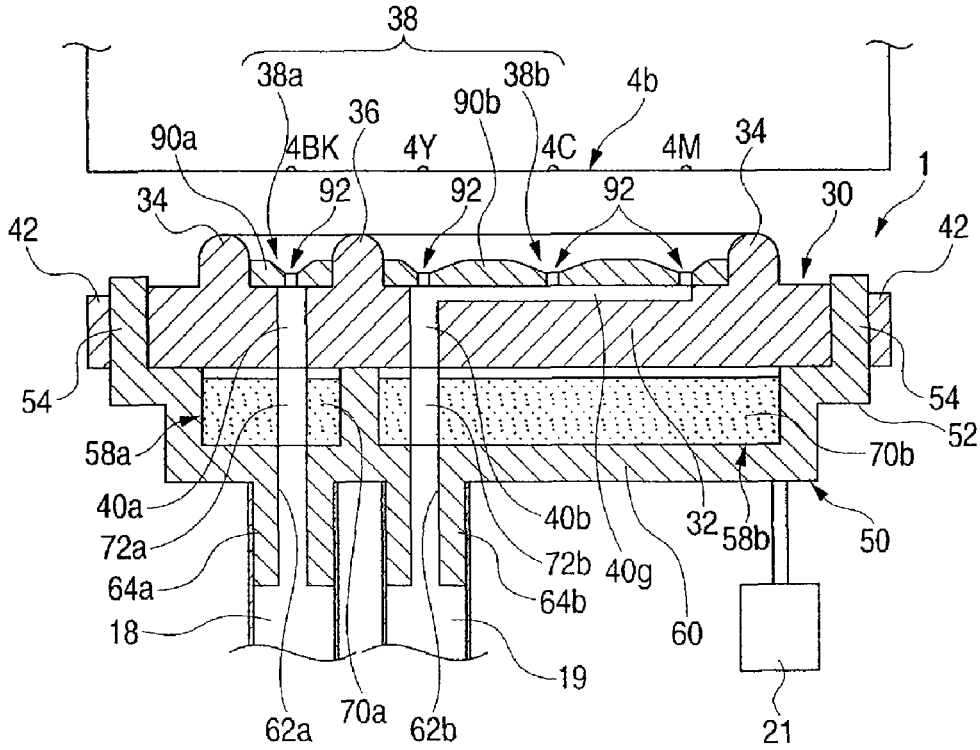
FIGS. 6A and 6B illustrate a capping operation of the capping device, with FIG. 6A showing a state in which the nozzle face of the ink jet head and a cap are not in contact with each other, and FIG. 6B showing a state in which the cap is in contact with the nozzle face.
Figure 6B:
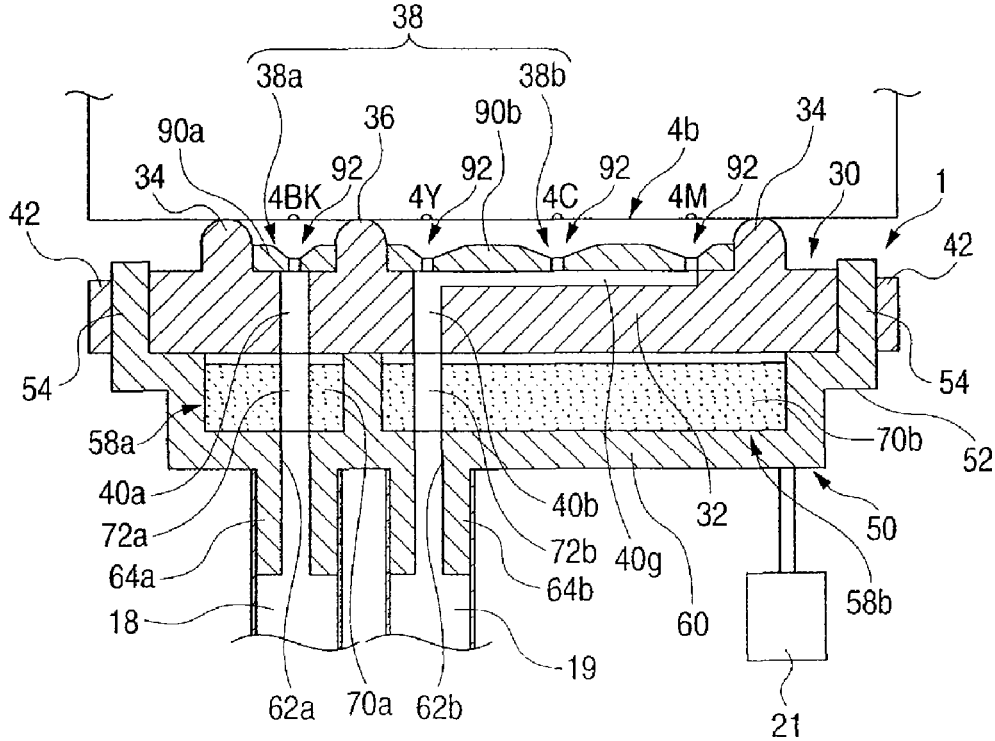

The recovery device 11 includes the capping device 1, the suction device 15 (see FIG. 5), a change-over valve 16 (see FIG. 5), suction tubes 18, 19, and 20, and a raising/lowering device 21 (see FIG. 6). The capping device 1 covers the nozzle face 4*b* by coming into contact with the nozzle face 4*b*. The suction device 15 communicates with the capping device 1, and is used to discharge ink. The change-over valve 16 is used to select ink to be sucked and discharged. The suction tubes 18, 19, and 20 are used to connect the capping device 1 to the suction device 15 through the change-over valve 16. The raising/lowering device 21, which is an example of a moving device, is used to move the capping device 1 vertically to cause the capping device 1 to contact the nozzle face 4*b*.

The capping device 1 includes a cap 30, a cap holder 50, and absorbers 70*a* and 70*b*. The cap 30 is configured to cover the nozzle face 4*b* of the ink jet head 4. The cap holder 50 supports the cap 30. The absorbers 70*a* and 70*b* absorb sucked ink.

The cap 30 is rectangular in plan view, and has a substantially recessed form in cross section having an open in upper side. The cap 30 has a cap substrate 32 rectangular in plan view, and a sealing lip 34 that is raised in an annular form at a location situated a short distance inward along the outer peripheral edge of the cap substrate 32 to form a suction chamber 38. A cap first surface portion of the cap substrate 32, which is circumscribed by the sealing lip 34, forms a bottom of the suction chamber 38. The sealing lip 34 is configured and dimensioned so that the nozzle arrays 4BK, 4Y, 4C, and 4M of the ink jet head 4 shown in FIG. 2 are located in the suction chamber 38 when the sealing lip 34 contacts the nozzle face 4*b*. A partition lip 36 is provided at the inner side of the sealing lip 34 so as to be parallel to the nozzle arrays 4BK, 4Y, 4C, and 4M and so as to partition the nozzle array 4BK from the nozzle arrays 4Y, 4C, and 4M. When the nozzle face 4*b* of the ink jet head 4 is covered with the cap 30, the suction chamber 38 is partitioned by the partition lip 36 into a suction chamber portion 38*a* and a suction chamber portion 38*b*. The suction chamber portion 38*a* corresponds to the nozzle array 4BK for black ink, and the suction chamber portion 38*b* corresponds to the nozzle arrays 4Y, 4C, and 4M for a plurality of color inks (see FIGS. 3 and 4). The cap substrate 32 of the cap 30 has a substantially rectangular form, in plan view, that is long in the Y direction in correspondence with the nozzle arrays 4BK, 4Y, 4C, and 4M. The suction chamber portions 38*a* and 38*b* are also substantially rectangular in plan view.

The cap 30 has suction openings 40*a* and 40*b* serving as fluid paths and extending through the cap substrate 32, that is, from the cap first surface portion of the cap substrate 32 forming the bottom of the suction chamber 38 to an opposite surface portion (a cap second surface portion) of the cap substrate 32. The suction openings 40*a* and 40*b* are located in the bottoms of the respective suction chamber portions 38*a* and 38*b* at longitudinal ends thereof. A suction groove 40*g* is formed in the bottom of the suction chamber portion 38*b* so that the suction groove 40*g* connects to the suction opening 40*b*. A total of four protrusions 42 for engagement with through-holes 56 of the cap holder 50 (described later) are formed, two at each of two side surfaces extending in the longitudinal direction of the cap substrate 32 of the cap 30. The protrusions 42 are disposed near longitudinal end portions of the side surfaces of the cap substrate 32.

The protrusions 42 of the cap 30 are provided for engagement with the through-holes 56 of the cap holder 50. Therefore, it is possible to provide recesses in place of the protrusions 42 of the cap 30, and protrusions in place of the through-holes 56 of the cap holder 50, to engage the cap 30 and the cap holder 50 to each other.

The cap 30 is formed of an elastic material, examples of which include rubber materials, such as natural rubber, isoprene rubber, styrene butadiene rubber, butadiene rubber, chloroprene rubber, nitrile rubber, butyl rubber, ethylene propylene rubber, urethane rubber, silicone rubber, acrylic rubber, chloro sulfonated polyethylene, fluorine rubber, and hydrogenated nitrile rubber.

Chips 90*a* and 90*b* having substantially the same shape in plan view as the suction chamber portions 38*a* and 38*b* are inserted in the respective suction chamber portions 38*a* and 38*b* of the cap 30. The chips 90*a* and 90*b* are rectangular plate members formed of a hard polymeric material, and are provided with guide grooves 92 in surfaces thereof. The guide grooves 92 respectively correspond to the nozzle arrays 4BK, 4Y, 4C, and 4M and extend to be parallel to the direction of extension of the nozzle arrays 4BK, 4Y, 4C, and 4M. The chips 90*a* and 90*b* have chip discharge openings 94 that extend through the chips 90*a* and 90*b* in the thickness direction and that are located at longitudinal one ends of the guide grooves 92. The chip discharge opening 94 of the chip 90*a* communicates with the suction opening 40*a*. One of the chip discharge openings 94 of the chip 90*b* communicates directly with the suction opening 40*b*, and the other two chip discharge openings 94 of the chip 90*b* communicate through the suction groove 40*g* with the suction opening 40*b*. By virtue of this structure, ink discharged from the nozzle holes 4*a* (forming the nozzle arrays 4BK, 4Y, 4C, and 4M) by a purging operation flows through the guide grooves 92, is quickly guided to the chip discharge openings 94, and is guided to the suction openings 40*a* and 40*b* of the suction chamber portions 38*a* and 38*b*. Since the chips 90*a* and 90*b* are formed of hard material, and are disposed in close contact with the bottoms of the suction chamber portions 38*a* and 38*b*, the chips 90*a* and 90*b* can reinforce the cap substrate 32 when the cap substrate 32 of the cap 30 is deformed due to negative pressure during the purging operation. When the deformation of the cap substrate 32 of the cap 30 is large, deformation, such as the falling of the sealing lip 34 or the partition lip 36, may cause the nozzle holes 4*a* and the cap 30 to contact each other. However, the existence of the chips 90*a* and 90*b* is effective in restricting the deformation. Since the thickness of the chips 90*a* and 90*b* is sufficiently less than the height of the sealing lip 34 and the height of the partition lip 36 of the cap 30, even if the sealing lip 34 and the partition lip 36 are in contact with the nozzle face 4*b* during the purging operation, it is possible to prevent the chips 90*a* and 90*b* from contacting the nozzle face 4*b*.

The cap holder 50 that supports the cap 30 is integrally formed using, for example, hard resin. The cap holder 50 is rectangular in plan view, and has a holder substrate 52 and side walls 54 protruding from the holder substrate 52. The side walls 54 are formed continuously along two side edges of the holder substrate 52 to extend in the longitudinal direction. The through-holes 56, to which the protrusions 42 formed at the side surfaces of the cap 30 are fitted, are formed in the side walls 54 so as to extend through the side walls 54 in the X direction (see FIG. 5). When the cap 30 is placed between the side walls 54, the protrusions 42 of the cap 30 are inserted into and engage the respective through-holes 56, so that the cap 30 is supported so as not to be inadvertently removed from the cap holder 50. The through-holes 56 can be replaced by recesses that do not extend through the side walls 54 as long as they can engage the protrusions 42 of the cap 30 so as not to be removed therefrom. As described above, if the protrusions 42 of the cap 30 are replaced by recesses, protrusions are used in place of the through-holes 56 of the cap holder 50, to make it possible to engage the cap 30 and the cap holder 50.

Figure 9:
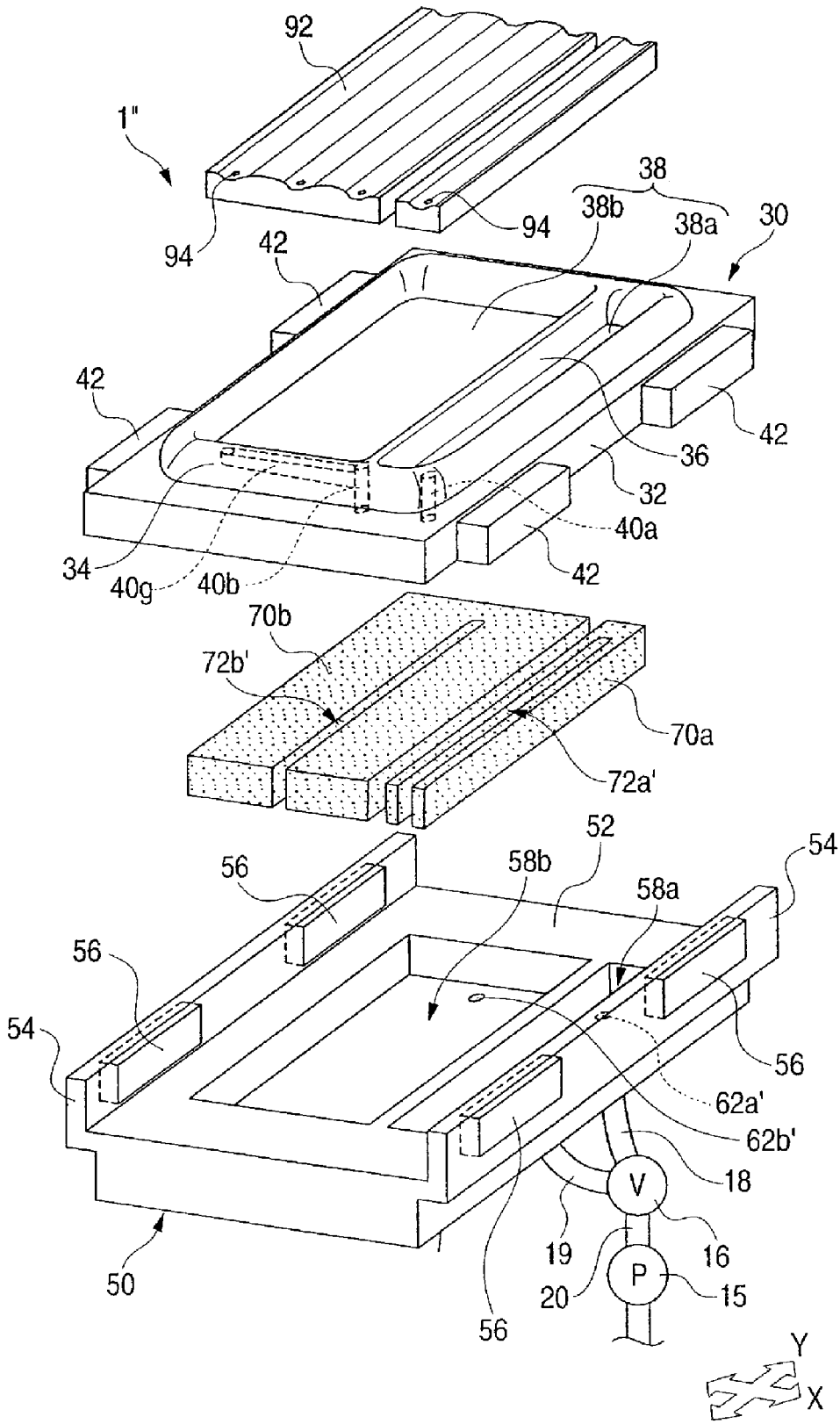
FIG. 9 is an exploded view illustrating still another capping device according to the present invention.

The holder substrate 52 of the cap holder 50 has accommodating portions 58*a* and 58*b* for accommodating the absorbers 70*a* and 70*b* (described later). Each of the accommodating portions 58*a* and 58*b* is a recessed form open toward a side facing the cap 30. The accommodating portions 58*a* and 58*b* are rectangular and substantially as large as the suction chamber portions 38*a* and 38*b* of the cap 30 in a plan view. Since the accommodating portions 58*a* and 58*b* are recessed from an upper surface of the holder substrate 52 and the side walls 54 protrudes from the upper surface of the holder substrate 52 at locations outward from the accommodating portions 58*a* and 58*b*, steps are formed between the accommodating portions 58*a* and 58*b* and the side walls 54. Discharge openings 62*a* and 62*b*, serving as fluid paths, extend through an accommodating bottom surface 60 of the holder substrate 52 in the thickness, that is, from a holder first surface portion of the holder 50 facing the cap 30 to an opposite surface portion (a holder second surface portion) of the holder 50. The discharge openings 62*a* and 62*b* are respectively located at longitudinal one ends of the accommodating portions 58*a* and 58*b* so as to correspond in position to the suction openings 40*a* and 40*b* of the cap 30. Connection portions 64*a* and 64*b* protrude downward from the holder second surface portion of the holder 50 to connect to the suction tubes 18 and 19 for communication of the discharge openings 62*a* and 62*b* with the suction tubes 18 and 19. Although the discharge openings 62*a* and 62*b* of the holder 50 and the suction openings 40*a* and 40*b* of the cap 30 are disposed in the same longitudinal end, they may be disposed at opposite longitudinal end as shown in FIG. 9.

The absorbers 70*a* and 70*b* are each in the form of a plate member that is formed of porous material, such as sponge, and that is rectangular in plan view. The absorbers 70*a* and 70*b* are accommodated in close contact with the inner surfaces of the accommodating portions 58*a* and 58*b* of the cap holder 50. At least one guide path 72*a* and at least one guide path 72*b* are provided in the respective absorbers 70*a* and 70*b* so as to extend through the respective absorbers 70*a* and 70*b* in the thickness direction thereof. The guide paths 72*a* and 72*b* connect the suction openings 40*a* and 40*b* of the cap 30 to the discharge openings 62*a* and 62*b* of the cap holder 50. The suction openings 40*a* and 40*b* oppose the respective discharge openings 62*a* and 62*b* with the respective absorbers 70*a* and 70*b* being disposed therebetween. As illustrated, the suction opening 40*a*, 40*b*, the guide path 72*a*, 72*b* and the discharge opening 62*a*, 62*b* are aligned on a line, respectively. Therefore, ink discharged from the nozzle holes 4*a* during a purging operation flows through the guide paths 72*a* and 72*b* from the suction openings 40*a* and 40*b*, and is quickly guided to the discharge openings 62*a* and 62*b*, while a portion of the ink is absorbed by the absorbers 70*a* and 70*b*. Consequently, the ink is discharged with good efficiency.

Although the cap 30 is formed so that the nozzle array 4BK, which ejects black ink, and the nozzle arrays 4Y, 4C, and 4M, which eject color inks, are covered by the suction chamber portions 38*a* and 38*b*, respectively, it may be formed so that all of the nozzle arrays are covered only by the sealing lip 34 without providing the partition lip 36. In this case, the chip 90 and the absorber 70 are no longer required to be divided into two members, and, the accommodating portion 58 of the cap holder 50 does not need to be divided into two portions. Therefore, the structure can be simplified, thereby facilitating designing and manufacturing.

Next, a procedure of assembling the capping device 1 will be described.

Absorbers 70*a* and 70*b* in which the guide paths 72*a* and 72*b* are preliminarily formed are accommodated in respective accommodating portions 58*a* and 58*b* of a cap holder 50. Here, the guide paths 72*a* and 72*b* of the respective absorbers 70*a* and 70*b* are disposed so as to oppose discharge openings 62*a* and 62*b* of the cap holder 50, respectively. A cap 30 is disposed so that suction openings 40*a* and 40*b* oppose the discharge openings 62*a* and 62*b* of the cap holder 50 with the absorbers 70*a* and 70*b* being disposed therebetween. Protrusions 42 are fitted to through-holes 56 of the cap holder 50, so that the cap 30 is fitted into the cap holder 50. This causes a lower surface portion (a cap second surface portion) of a cap substrate 32 of the cap 30 to closely contact an upper surface portion (a holder first surface portion) of a holder substrate 52 of the cap holder 50 around the accommodating portions 58*a* and 58*b*, so that accommodating portions 58*a* and 58*b* of the cap holder 50 are sealingly covered by the cap 30. This causes the interior of the accommodating portions 58*a* and 58*b* to be in a hermetically sealed state, so that the humidity in the accommodating portions 58*a* and 58*b* can be maintained over a long period of time. Parts for securing only the absorbers 70*a* and 70*b* are no longer required, so that the number of assembly man-hours can be reduced. In this connection, the lower surface portion (the cap second surface portion) of the cap substrate 32 of the cap 30 also closely contact an upper surfaces of the absorbers 70*a* and 70*b* so that the absorbers 70*a* and 70*b* are slightly compressed by the lower surface portion (the cap second surface portion) of the cap substrate 32 and bottom surfaces of the accommodating portions 58*a* and 58*b*. Then, chips 90*a* and 90*b* are inserted into suction chamber portions 38*a* and 38*b* of the cap 30 so that chip discharge openings 94 communicate with the suction openings 40*a* and 40*b* of the cap 30 directly or through the suction groove 40*g*. In the assembly procedure, it is possible to fit the cap 30 into the cap holder 50 after inserting the chips 90*a* and 90*b* into the cap 30.

The capping device 1 is so designed that the sealing lip 34 of the cap 30 protrudes by a greater amount than the side walls 54 of the cap holder 50, and the upper surfaces of the chips 90*a* and 90*b* are lower than the upper surface of the sealing lip 34 of the cap 30. Therefore, even if the cap 30 contacts the nozzle face 4*b* of the ink jet head 4, the cap holder 50 and the chips 90*a* and 90*b* are not in contact with the nozzle face 4*b*. Therefore, it is possible to prevent ejection problems and damage to the nozzle holes 4*a*.

The form of the capping device 1 is not limited to a rectangular form that is long in the sub-scanning directions (Y directions) in plan view. It is possible to increase the width, so that the capping device 1 covers a wider range of the nozzle face 4*b* of the ink jet head 4.

The operation of the recovery device 11 including the capping device 1 will be described. The suction device 15 (FIG. 5) of the recovery device 11 is connected to the change-over valve 16 through the suction tube 20, and the change-over valve 16 is connected to the capping device 1 through the suction tubes 18 and 19.

First, the carriage 9 to which the ink jet head 4 is mounted is driven, and moved to a position where the nozzle face 4*b* opposes the capping device 1. Then, the capping device 1 is moved towards the ink jet head 4 by the moving device, such as raising/lowering device 21, to cause an end of the sealing lip 34 and an end of the partition lip 36 of the cap 30 to contact the nozzle face 4*b*. This causes the nozzle array 4BK for black ink and the nozzle arrays 4Y, 4C, and 4M for color inks to be covered by the respective suction chamber portions 38*a* and 38*b*.

The change-over valve 16 is switched to a position causing the capping device 1 and the suction device 15 to communicate with each other. The suction device 15 is driven in a state in which the capping device 1 is sealed by the nozzle face 4*b*. By causing the pressure in the capping device 1 to be negative, i.e. by applying a negative pressure to the capping device 1, air bubbles or viscosity-increased ink in the ink jet head 4 is sucked from the nozzle holes 4*a* through the capping device 1. Since the suction openings 40*a* and 40*b* of the cap 30, the respective guide paths 72*a* and 72*b* of the absorbers 70*a* and 70*b*, and the respective discharge openings 62*a* and 62*b* of the cap holder 50 are arranged in straight lines, negative pressure smoothly acts upon the entire interior of the cap 30.

Ink sucked from the nozzles 4*a* is sucked to the suction openings 40*a* and 40*b* of the cap 30 through the guide grooves 92 and the suction groove 40*g*, and also through a very small gap between the cap 30 and the chips 90*a* and 90*b* by capillary phenomenon. The sucked ink flows to the guide paths 72*a* and 72*b* of the respective absorbers 70*a* and 70*b*, so that a portion of the ink is absorbed by the absorbers 70*a* and 70*b*, while the remaining ink that was not absorbed by the absorbers 70*a* and 70*b* is discharged outside the capping device 1 through the discharge openings 62*a* and 62*b* of the cap holder 50, and is transported to a waste-liquid reservoir (not shown).

When the ink jet head 4 is not used, such as when the ink jet head 4 is in a non-recording state and purging is not performed, the change-over valve 16 is switched to a closed state to break the communication between the capping device 1 and the suction device 15, and the capping device 1 is brought into contact with the nozzle face 4*b*, thereby forming a hermetically sealed space in the cap 30. That is, by covering the nozzle face 4*b* with the capping device 1 and shielding the nozzle holes 4*a* from the atmosphere, it is possible to prevent, for example, dust from adhering to the nozzle holes 4*a*. Further, since a suitable amount of ink is absorbed by the absorbers 70*a* and 70*b*, the nozzle holes 4*a* can be maintained in a moisture retention state. Furthermore, pushing force generated by the raising/lowering device 21 to contact the cap 30 with the nozzle face 4*b* also act on the cap 30 and the cap holder 50. Consequently, the accommodating portions 58*a* and 58*d* also become hermetically sealed spaces. This also makes it possible to maintain a moisture retention state.

Figure 7:
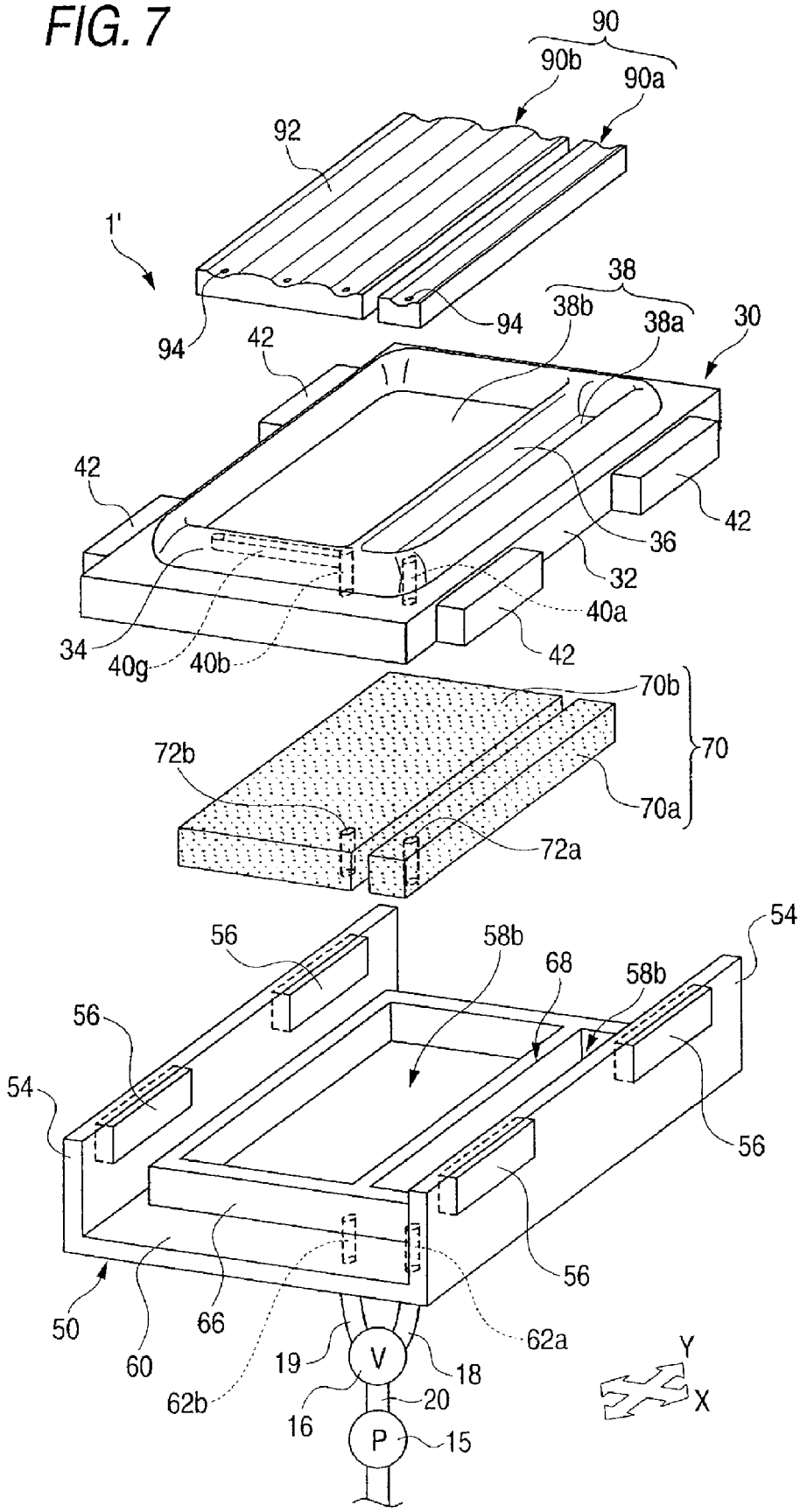
FIG. 7 is an exploded view illustrating another capping device according to the present invention.

A capping device 1' and a capping device 1" will be described with reference to FIGS. 7 to 9. In FIGS. 7 to 9, similar or corresponding structural features to those in the capping device 1 will be given the same reference numerals. The illustrations do not show a raising/lowering device 21.

In case of the capping device 1', the forms of accommodating portions 58*a* and 58*b* of a cap holder 50 accommodating absorbers 70*a* and 70*b* are different. That is, as shown in FIG. 7, an annular wall 66 is provided in a standing manner so as to be rectangular in plan view on the upper surface of an accommodating bottom surface 60 of the cap holder 50; the inner side of the annular wall 66 is divided in two by a partition wall 68; and these divided portions are defined as the accommodating portions 58*a* and 58*b* that accommodate the absorbers 70*a* and 70*b*. A cap 30 is fitted to the cap holder 50 with a lower surface of a cap substrate 32 being in close contact with an upper surface of the annular wall 66 and an upper surface of the partition wall 68 while the absorbers 70*a* and 70*b* are accommodated in the respective accommodating portions 58*a* and 58*b*.

Figure 8A:
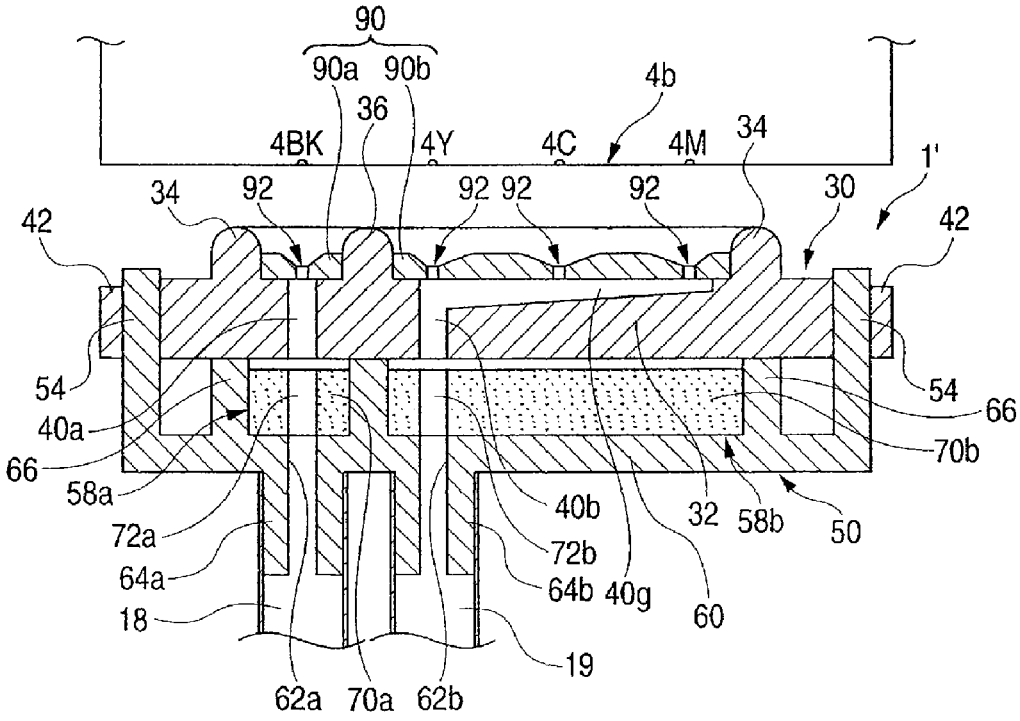
FIGS. 8A and 8B illustrate a capping operation of the capping device shown in FIG. 7, with FIG. 8A showing a state in which a nozzle face of an ink jet head and a cap are not in contact with each other, and FIG. 8B showing a state in which the cap is in contact with the nozzle face.
Figure 8B:
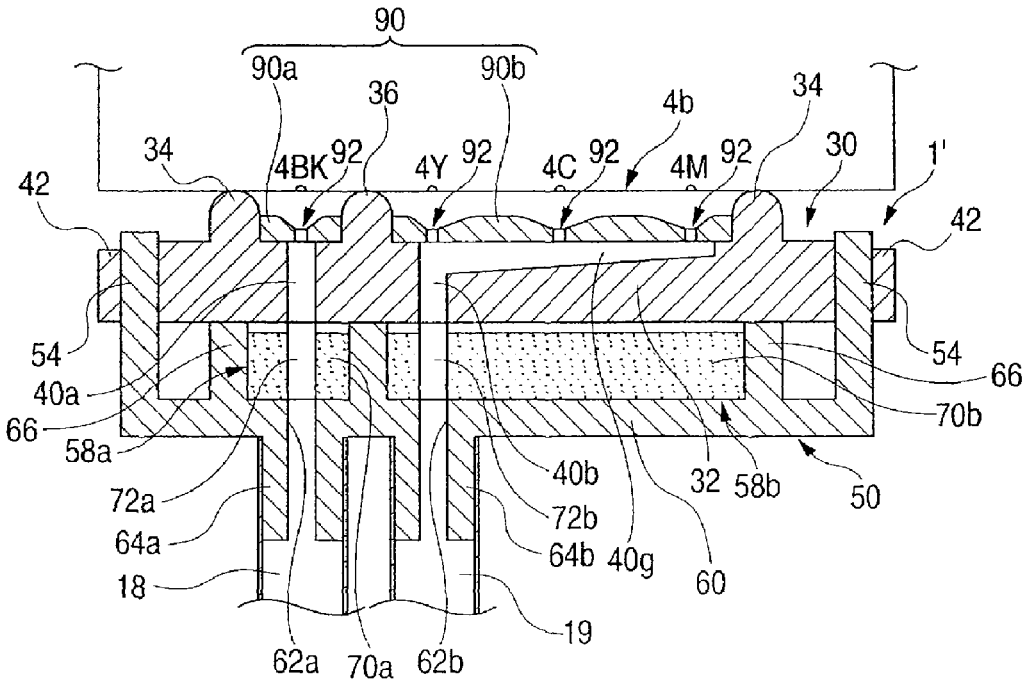

As shown in FIG. 8B, the capping device 1' is so designed that when the cap 30 comes into contact with a nozzle face 4*b*, a pushing force resulting therefrom causes the lower surface of the cap substrate 32 of the cap 30 and the upper surface of the annular wall 66 to be in close contact with each other. Therefore, in a purging operation, the sealing properties of the interiors of the accommodating portions 58*a* and 58*b* are ensured, so that ink can be efficiently discharged. In addition, the suction groove 40*g* of the capping device 1' is so designed that a bottom surface of the suction groove 40*g* is inclined downward toward the suction opening 40*b* in order to facilitate ink flow toward the suction opening 40*b* during purging operation. In this connection, although suction groove 40*g* is formed in the cap 30 in the capping devices 1 and 1', the suction groove 40*g* may be formed in the chip 90*b* or may be formed in both the cap 30 and the chip 90*b*.

Further, as shown in FIGS. 8A and 8B, the absorbers 70*a* and 70*b* are so dimensioned that a gap is formed between the absorber 70*a*, 70*b* and the lower surface of the cap 30 when the absorber 70*a*, 70*b* is accommodated in the accommodating portion 58*a*, 58*b*.

In case of a capping device 1", the forms of guide paths 72*a'* and 72*b'* of absorbers 70*a* and 70*b* are different. That is, as shown in FIG. 9, when suction openings 40*a* and 40*b* of a cap 30 and discharge openings 62*a'* and 62*b'* of a cap holder 50 are positioned at opposite sides in the longitudinal direction, guide paths 72*a'* and 72*b'* of absorbers 70*a* and 70*b* are provided by forming cutaway portions in a range including the suction openings 40*a* and 40*b* and the discharge openings 62*a'* and 62*b'* in plan view (that is, extending so as to connect the suction openings and the discharge openings). These cutaway portions extend through the absorbers 70*a* and 70*b* in the longitudinal direction. Accordingly, when the guide paths 72*a'* and 72*b'* are formed as cutaway portions, suction during a purging operation is not hampered, and the absorbers 70*a* and 70*b* are easily formed, so that they can be formed as appropriate in accordance with the design of the cap 30 and the cap holder 50.

As described above, an accommodating portion that accommodate an absorber is formed in a cap holder, and a cap is supported by the cap holder by engaging the cap holder with the cap, to thereby hold the absorber in the accommodating portion. Therefore, it is possible to provide a capping device for an ink jet head, which has a simple structure, has few parts, and is easily assembled. In addition, a guide path that connects a suction opening and a discharge opening extends through the absorber. Therefore, liquid is quickly guided to the discharge opening, so that discharging efficiency can be increased.

The present invention can provide the following illustrative, non-limiting embodiments:

(1) A capping device for an ink jet head, include: a cap that is configured to cover a nozzle face of the ink jet head; a cap holder that supports the cap from a side opposite from the ink jet head; and an absorber. The absorber is held between the cap and the cap holder. The cap has a suction opening extending through the cap from a side of the nozzle face toward the side opposite from the ink jet head. The cap holder has a discharge opening extending through the cap holder from a side of the absorber to a back-surface side of the cap holder. The absorber has a guide path extending through the absorber in a thickness direction. The guide path connects the suction opening and the discharge opening to each other, and discharges liquid from the suction opening to the discharge opening.

According to the capping device of (1), the absorber is held between the cap and the cap holder, and therefore a part that secures only the absorber is no longer required. Therefore, assembly can be performed without performing steps, such as a thermal caulking step or an ultrasonic adhesion step, for securing this part. In addition, since the guide path extends through and is provided at the absorber so as to connect the suction opening and the discharge opening to each other, a portion of the liquid sucked in the cap from the nozzle hole of the ink jet head is guided to the guide path and discharged from the discharge opening, and the remaining liquid is absorbed by the absorber. Therefore, the liquid existing in the cap can be smoothly guided to the discharge opening. Further, the existence of the absorber allows more liquid existing in the cap to be discharged from the interior of the cap.

Since the number of parts assembly steps is reduced, production efficiency can be increased, and costs can be reduced. In addition, since the nozzle hole of the ink jet head can be maintained in a good state, a high quality image can be maintained.

(2) In the capping device of (1), the cap has a substrate and a sealing lip having a substantially recessed form in cross section. The substrate is rectangular in plan view and has a cap bottom surface provided opposite to the nozzle face. The sealing lip opens at the side of the nozzle face, is raised in an annular form, and contacts the nozzle face to cover a nozzle hole. The cap holder has a bottom portion and side walls. The bottom portion of the cap holder faces the bottom surface of the cap through the absorber. The side walls are raised from the bottom portion of the cap holder to extend along side surfaces of the substrate. The cap is fitted and mounted between the side walls.

According to the capping device of (2), the cap can be supported by the cap holder by fitting the cap between the side walls, and therefore the cap is easily assembled to the cap holder.

Since the absorber is easily assembled, production efficiency can be increased.

(3) In the capping device of (2), the bottom portion of the cap holder has an accommodating portion that opens to a side of the cap and that accommodates the absorber. The cap is mounted to the cap holder to cover the open side of the accommodating portion by the bottom surface of the cap.

According to the capping device (3), the absorber can be easily accommodated in the cap holder. In addition, if the cap is assembled to the cap holder, the absorber can be secured by the cap. Therefore, a part and a step for securing only the absorber are no longer required. Further, since the sealing property in the accommodating portion is ensured, the humidity in the accommodating portion can be maintained for a long period of time.

Since the absorber can be easily accommodated in the cap holder and the humidity in the accommodating portion can be maintained, the nozzle hole can be maintained in a good state over a long period of time.

(4) In the capping device of (3), a recess is provided in the bottom portion of the cap holder, and the open side of the accommodating portion is covered by bringing the bottom portion of the cap and the bottom surface of the cap holder into contact with each other.

According to the capping device of (4), the absorber can be easily accommodated in the cap holder. In addition, the bottom surface of the cap can secure the entire absorber.

Using a simple structure, the absorber can be accommodated in the cap holder, so that it can be easily secured.

(5) In the capping device of (3), the accommodating portion is disposed by raising an annular wall from the bottom portion of the cap holder toward the cap, and the open side of the accommodating portion is covered by bringing the bottom surface of the cap and a top end of the annular wall into contact with each other.

According to the capping device of (5), the absorber can be accommodated in the cap holder using a simple structure. In addition, the bottom surface of the cap can secure the entire absorber.

Using a simple structure, the absorber can be accommodated in the cap holder, so that it can be easily secured.

(6) In the capping device of (2), one of the side wall and the substrate opposing the side wall is provided with a protrusion that is fitted in a direction intersecting a direction in which the cap is fitted into the cap holder, and the other of the side wall and the substrate is provided with a recess or a through-hole that is fitted in the direction intersecting the direction in which the cap is fitted into the cap holder.

According to the capping device of (6), the cap can be prevented from being inadvertently removed from the cap holder.

Since the cap is not inadvertently removed from the cap holder, reliability can be increased.

(7) In the capping device of (1), the suction opening and the discharge opening are disposed opposite to each other with the guide path being disposed therebetween.

According to the capping device of (7), the distance between the suction opening and the discharge opening is reduced, so that discharging of the liquid in the cap from the discharge opening is facilitated.

The ink jet head can be smoothly maintained without making the structure of the absorber complicated.

(8) In the capping device of (1), the guide path is disposed by extending through the absorber in a direction in which the suction opening and the discharge opening are connected to each other.

According to the capping device (8), the suction opening and the discharge opening need not oppose each other, so that the degree of freedom with which the cap and the cap holder are designed is increased.

(9) In the capping device of (2), the nozzle face is provided with a plurality of nozzle holes disposed in an array, a chip having a guide groove is disposed within the sealing lip. The guide groove guides the liquid along a direction of the array of the nozzle holes. In addition, the liquid that has passed along the guide groove is guided to the suction opening.

According to the capping device of (9), the liquid can be prevented from remaining in the cap by disposing the chip, having the guide groove, within the sealing lip.

Since the liquid is prevented from remaining in the cap, discharge failure, caused by adherence of remaining liquid to the nozzle face, can be prevented from occurring.

(10) A recovery device includes: the capping device of any one of (1) to (9); a raising/lowering device for bringing the cap into contact with the nozzle face; and a suction device for sucking the liquid from the ink jet head. The suction device is connected to the discharge opening, and the liquid is sucked from the suction opening to the discharge opening through the guide path.

According to the recovery device of (10), the parts assembly steps are simplified. In addition, pushing force that is generated by bringing the cap into contact with the nozzle face by the raising/lowering device pushes the cap and the cap holder. Therefore, the interior of the accommodating portion is in a sealed state, so that the sealing property in the accommodating portion is ensured. Consequently, the humidity in the accommodating portion can be maintained for a long period of time.

The recovery device of (10) makes it possible to provide a liquid discharging apparatus which can increase production efficiency and which can maintain good image quality.

What is claimed is:

1. A capping device for an ink jet head having a nozzle face, comprising:

a cap configured to cover the nozzle face, the cap having a cap first surface portion oriented to face the nozzle face and a cap second surface portion opposite from the cap first surface portion, the cap having a suction opening extending through the cap from the cap first surface portion to the cap second surface portion;

a cap holder supporting the cap, the cap holder having a holder first surface portion facing the cap second surface portion, and a holder second surface portion opposite from the holder first surface portion, the cap holder having a discharge opening extending from the holder first surface portion to the holder second surface portion; and an absorber held between the cap second surface portion and the holder first surface portion, the absorber having a guide path that extends through the absorber and that communicates with the suction opening and the discharge opening, wherein the cap comprises:

a cap substrate having the cap second surface portion as a bottom surface; and a sealing lip protruding from the cap and circumscribing the cap first surface portion to define a recess having the cap first surface portion as a recess bottom surface, the sealing lip being configured to sealingly contact the nozzle face, wherein the cap holder comprises:

a holder substrate having the holder second surface portion as a bottom surface; and first side walls protruding from the cap holder, and wherein the cap is fitted to the first side walls of the cap holder so that the cap second surface portion faces the holder first surface portion and the first side walls of the cap holder circumscribes the holder first surface portion to define an accommodating recess having the holder first surface portion as an accommodating recess bottom surface, and wherein when the cap is fitted to the first side walls of the cap holder, the cap second surface portion sealingly closes the accommodating recess in which the absorber is accommodated.

2. The capping device according to claim 1, wherein the first side walls of the cap holder has a step at an open side of the accommodating recess, and when the cap is fitted to the first side walls of the cap holder, the cap second surface portion sealingly contacts the step.

3. The capping device according to claim 1, wherein the cap holder further includes second side walls protruding from the cap holder and circumscribing the holder first surface portion to define an accommodating recess having the holder first surface portion as an accommodating recess bottom surface, and wherein when the cap is fitted to the first side walls of the cap holder, the cap second surface portion sealingly contacts an upper edge of the second side walls to close the accommodating recess in which the absorber is accommodated.

4. The capping device according to claim 1, further comprising:

a protrusion provided on one of the first side wall of the cap holder and the cap substrate; and a recess or through-hole provided in the other of the first side wall of the cap holder and the cap substrate, wherein the protrusion is engaged with the recess or through-hole in a direction intersecting a direction in which the cap is fitted to the cap holder.

5. The capping device according to claim 1, wherein the suction opening and the discharge opening are aligned on a line, and the guide path extends through the absorber on and along the line.

6. The capping device according to claim 1, wherein the guide path is elongated in a direction in which the suction opening is distanced away from the discharge opening.

7. The capping device according to claim 1, further comprising:

a chip disposed on the cap first surface portion circumscribed by the sealing lip, the chip having a guide groove extending in a predetermined direction and a chip discharge opening for communication between the suction opening and the guide groove, wherein when the cap covers the nozzle face, the guide groove extends along an array of nozzle holes formed in the nozzle face.

8. A recovery device for an ink jet head having a nozzle face, comprising:

a capping device comprising:

a cap configured to cover the nozzle face, the cap having a cap first surface portion oriented to face the nozzle face and a cap second surface portion opposite from the cap first surface portion, the cap having a suction opening extending through the cap from the cap first surface portion to the cap second surface portion;

a cap holder supporting the cap, the cap holder having a holder first surface portion facing the cap second surface portion, and a holder second surface portion opposite from the holder first surface portion, the cap holder having a discharge opening extending from the holder first surface portion to the holder second surface portion; and an absorber held between the cap second surface portion and the holder first surface portion, the absorber having a guide path that extends through the absorber and that communicates with the suction opening and the discharge opening;

a moving device for moving the capping device to contact the cap with the nozzle face; and a suction device, connected to the discharge opening, for sucking liquid from the ink jet head through the suction opening, the guide path and the discharge opening, wherein the cap comprises:

a cap substrate having the cap second surface portion as a bottom surface; and a sealing lip protruding from the cap and circumscribing the cap first surface portion to define a recess having the cap first surface portion as a recess bottom surface, the sealing lip being configured to sealingly contact the nozzle face, wherein the cap holder comprises:

a holder substrate having the holder second surface portion as a bottom surface; and first side walls protruding from the cap holder, and wherein the cap is fitted to the first side walls of the cap holder so that the cap second surface portion faces the holder first surface portion and the first side walls of the cap holder circumscribes the holder first surface portion to define an accommodating recess having the holder first surface portion as an accommodating recess bottom surface, and wherein when the cap is fitted to the first side walls of the cap holder, the cap second surface portion sealingly closes the accommodating recess in which the absorber is accommodated.

9. A capping device for a fluid ejection device, comprising:

a cap having a fluid receptacle and a first fluid path;

a cap holder supporting the cap and having a second fluid path; and an absorber disposed between and supported by the cap and the cap holder, the absorber having a third fluid path, wherein negative pressure is applicable to the fluid receptacle at least through the first, second and third fluid paths, wherein the cap comprises:

a sealing lip protruding from the cap and circumscribing a cap first surface portion to define a recess having the cap first surface portion as a recess bottom surface, the sealing lip being configured to sealingly contact a nozzle face; and a cap substrate having a cap second surface portion as a bottom surface;

wherein the cap holder comprises:

a holder substrate having a holder surface portion as a bottom surface; and first side walls protruding from the cap holder, and wherein the cap is fitted to the first side walls of the cap holder so that the cap second surface portion faces the holder surface portion and the first side walls of the cap holder circumscribes the holder surface portion to define an accommodating recess having the holder surface portion as an accommodating recess bottom surface, and wherein when the cap is fitted to the first side walls of the cap holder, the cap second surface portion sealingly closes the accommodating recess in which an absorber is accommodated.

* * * * *